US007129809B2

(12) United States Patent
Estrov

(10) Patent No.: US 7,129,809 B2
(45) Date of Patent: Oct. 31, 2006

(54) SURFACE MOUNT MAGNETIC COMPONENT ASSEMBLY

(76) Inventor: Alexander Estrov, 5782 NW. 38th Ter., Boca Raton, FL (US) 33496

( * ) Notice: Subject to any disclaimer, the term of this patent is extended or adjusted under 35 U.S.C. 154(b) by 32 days.

(21) Appl. No.: 10/965,554

(22) Filed: Oct. 14, 2004

(65) Prior Publication Data

US 2006/0082431 A1 Apr. 20, 2006

(51) Int. Cl.
*H01F 27/06* (2006.01)

(52) U.S. Cl. ..... 336/65; 336/200; 336/192; 336/198

(58) Field of Classification Search ..... 336/200, 336/65, 192, 198, 208, 223, 232
See application file for complete search history.

(56) References Cited

U.S. PATENT DOCUMENTS 5,657,942 A * 8/1997 Faulk ..... 242/443.1
6,335,671 B1 * 1/2002 Roessler et al. ..... 336/65

FOREIGN PATENT DOCUMENTS

JP 406163266 A * 6/1994

* cited by examiner

*Primary Examiner*—Anh Mai
(74) *Attorney, Agent, or Firm*—Gunsteer, Yoakley & Stewart, P.A.

(57) ABSTRACT

A planar magnetic device comprising a molded header and a planar core assembly, and a method of making a planar magnetic device. The molded header has first, second, third, and fourth sides and an aperture in the center. The first side has a plurality of terminals positioned through it. The third and fourth sides have upper surfaces that are lower than the upper surfaces of the first side. The planar core assembly comprises planar windings and a core. One side of the planar winding has a plurality of terminals with through-holes so that the primary terminals of the header are positioned through the through-holes. The core surrounds at least a portion of the planar windings. The core is shaped so that a first portion of the core is positioned in the aperture, a second portion of the core is positioned on the upper surface of the third side, and a third portion of the core is positioned on the upper surface of the fourth side.

28 Claims, 10 Drawing Sheets

SURFACE MOUNT MAGNETIC COMPONENT ASSEMBLY

CROSS-REFERENCE TO RELATED APPLICATIONS

Not applicable

STATEMENT REGARDING FEDERALLY SPONSORED RESEARCH OR DEVELOPMENT

Not Applicable

FIELD OF THE INVENTION

The invention relates generally to surface mount magnetic component assemblies, and more particularly, to an improved low-profile coplanar surface mount magnetic component assembly.

BACKGROUND OF THE INVENTION

The main difficulty in packaging high frequency power transformers and multi-winding inductors for surface mounted device applications is to provide accurate coplanarity of the device terminals during manufacturing and installation on the mounting surface or substrate. Prior art headers have used a solid plastic base with molded copper or brass terminals to prevent terminal to wire or terminal to planar winding connection from re-flow during installation and losing coplanarity with other terminals and with the bottom of the core. The ferrite cores have been mounted on the top of the plastic header or base. These prior art devices have been a problem in many applications because of the height of the device makes it unsuitable or difficult to use in low profile converters and power supplies. In addition, these prior art devices have presented cooling problems in that the plastic header between the core and the substrate acts as a thermal barrier. This cooling problem has been solved in the past by either de-rating the surface mount device, thus increasing the cost and the size of the power converter, or by using other cooling methods such as fans.

Other prior art devices have used separate surface mount strips with terminals for the primary and secondary sides of transformers. Although this configuration solves the problem of cooling the core and meets the coplanarity requirement between primary pins or secondary pins, it does not solve the problem of coplanarity between all of the terminals, that is, the primary and secondary sides, as well as the core.

Accordingly, there has been a long felt need in the art to provide a surface mount magnetic component assembly that provides coplanarity between all of the pins and the core, that presents a low profile, and that provides improved cooling capabilities.

SUMMARY OF THE INVENTION

In accordance with the present invention, there is provided a planar magnetic device comprising a molded header and a planar core assembly. The molded header has first, second, third, and fourth sides and an aperture in the center. The first side has a plurality of terminals positioned through it. The third and fourth sides have upper surfaces that are lower than the upper surfaces of the first side. The planar core assembly comprises planar windings and a core. One side of the planar winding has a plurality of terminals with through-holes so that the primary terminals of the header are positioned through the through-holes. The core surrounds at least a portion of the planar windings. The core is shaped so that a first portion of the core is positioned in the aperture, a second portion of the core is positioned on the upper surface of the third side, and a third portion of the core is positioned on the upper surface of the fourth side.

In accordance with the present invention, there is provided a planar transformer comprising a molded header and a planar core assembly. The molded header has first, second, third, and fourth sides and an aperture in the center. The first side has a plurality of primary terminals positioned through it, and the second side has a plurality of secondary terminals positioned through it. The third and fourth sides have upper surfaces that are lower than the upper surfaces of the first and second sides. The planar core assembly comprises first and second planar windings and a core. One side of the first planar winding has a plurality of first terminals with through-holes so that the primary terminals of the header are positioned through the through-holes of said first terminals. One side of the second planar winding has a plurality of second terminals with through-holes so that the secondary terminals of the header are positioned through the through-holes of the second terminals. The core surrounds at least a portion of the first and second planar windings. The core is shaped so that a first portion of the core is positioned in the aperture, a second portion of the core is positioned on the upper surface of the third side, and a third portion of the core is positioned on the upper surface of the fourth side.

In another embodiment of the invention, the third and fourth walls of the header have raised portions, and the core is positioned between these raised sidewalls. In still another embodiment, the bottom of the third and fourth sides is coplanar with the heads of the primary and secondary terminals.

In an alternative embodiment of the present invention, there is provided a magnetic device comprising a molded header and a wire wound core assembly. The molded header has first, second, third, and fourth sides and an aperture in the center. The first side has a plurality of terminals positioned through it. The third and fourth sides have upper surfaces that are lower than the upper surfaces of the first side. The planar core assembly comprises wire windings and a core. The core surrounds at least a portion of the wire windings. The core is shaped so that a first portion of the core is positioned in the aperture, a second portion of the core is positioned on the upper surface of the third side, and a third portion of the core is positioned on the upper surface of the fourth side.

In accordance with the inventions there is also provided a method of making a planar magnetic device comprising the steps of: forming a header with a plurality of terminals and with two other sides that are lower than the side with the terminals; positioning a planar core assembly on the header such that a portion of the planar core assembly is located on the header and the header terminals are positioned through-holes in the planar windings of the planar core assembly and the planar core assembly is positioned on the upper surface of the lower sides of the header; bonding the planar core assembly to the lower walls of the header; and providing an electrical connection between the terminals of the header and the planar windings.

The primary and secondary terminals can be molded in place during the manufacture of the header or are rigidly attached to the header by other suitable means. The molded header holds the primary and secondary terminals 18 rigidly in position and maintains the coplanarity of the primary and secondary terminals. The header also facilitates assembly of the planar magnetic device, such as a planar transformer or planar inductor, which may have one or more coils.

The raised sidewalls assist in the alignment of the core assembly by guiding the core assembly into position on the pins of the primary and secondary terminals. The two nonterminal sides of the header, i.e., the side bars, allow the core to sit lower than prior art planar transformers. In addition to assisting in alignment during assembly, the raised sidewalls make the entire assembly stronger since they provide a large bonding surface. The core is bonded or glued to the side bars and the raised sidewalls making an integrated package that holds together better than prior art planar transformers and planar inductors. When the planar magnetic device of the present invention is mounted on a mounting/cooling substrate or printed circuit board, the slight air gap between the bottom of the center section of the core and the surface of the mounting/cooling surface or printed circuit board can be filled with a soft bonding compound or insulating film with adhesive backing to allow heat transfer from the core to the surface of the mounting/cooling substrate or printed circuit board. Soft bonding of the core to the mounting surface improves mechanical stability and resistance to shock and vibration. Insulating film under the core allows the traces on the printed circuit board to pass under the core.

The subject invention provides a surface mount magnetic component assembly that provides coplanarity of all terminals and the core, reduced height of the overall package, provides for improved cooling by allowing efficient heat exchange between the core and the surface of the mounting/cooling substrate without a thermal barrier, a mechanical package that has structural integrity for demanding applications, and is capable of being produced in a cost-effective manner.

Other advantages and applications of the present invention will be made apparent by the following detailed description of the preferred embodiment of the invention.

DETAILED DESCRIPTION OF THE INVENTION

Figure 1:
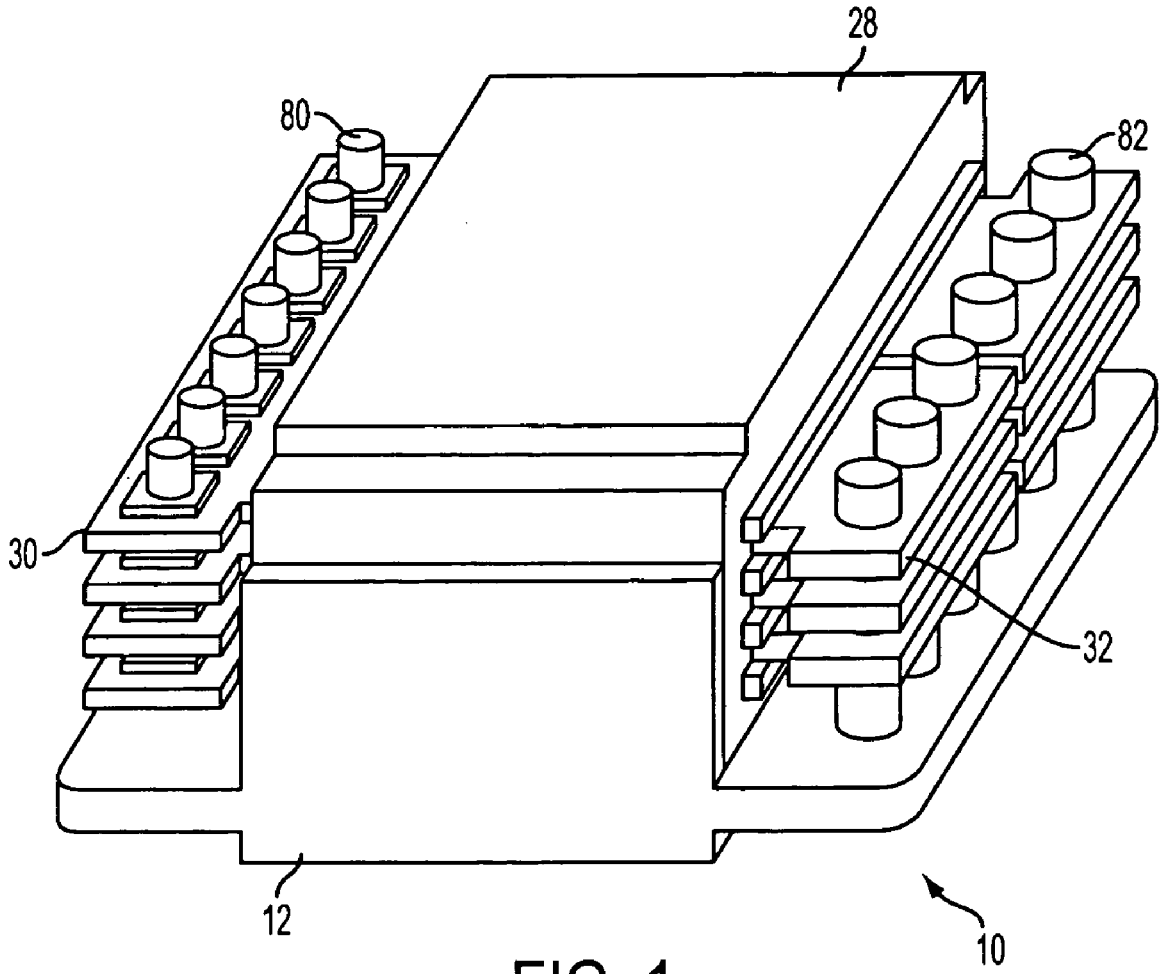
FIG. 1 is a perspective view of the planar transformer of the present invention.
Figure 2:
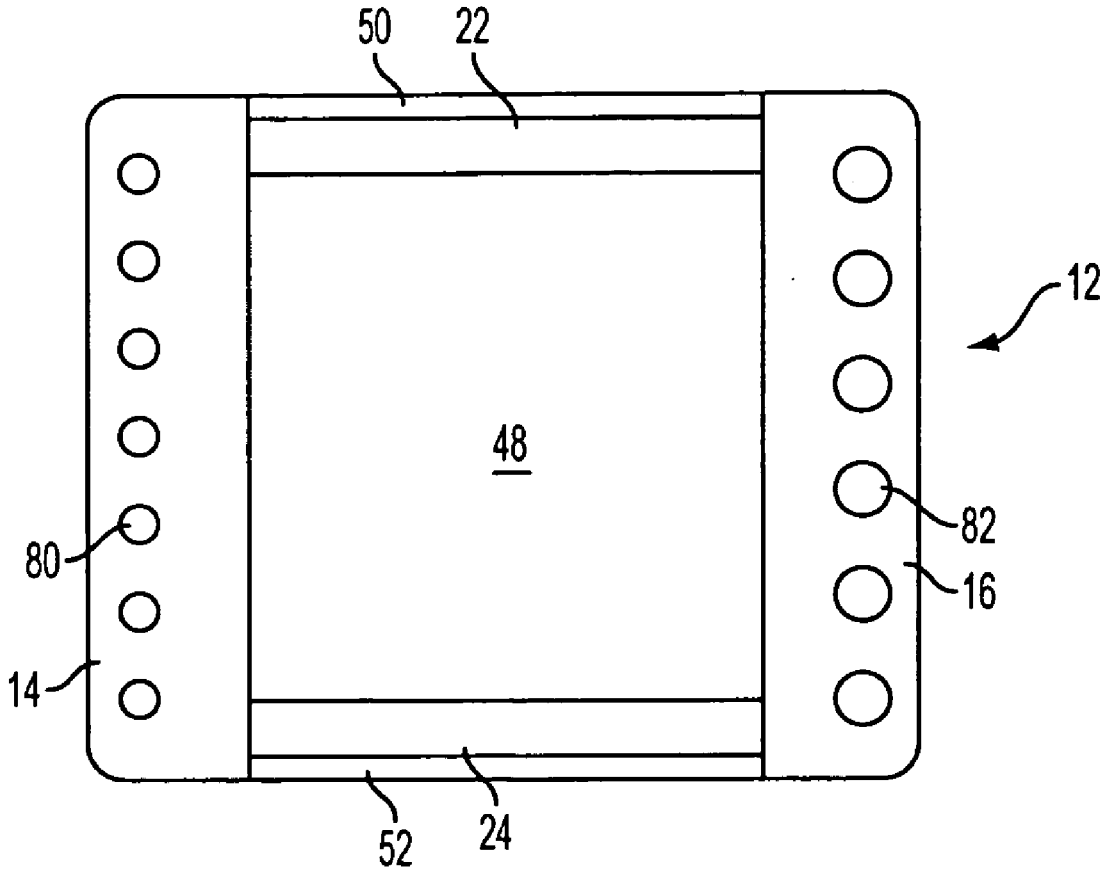
FIG. 2 is a top plan view of the header of the planar transformer shown in FIG. 1.
Figure 3:
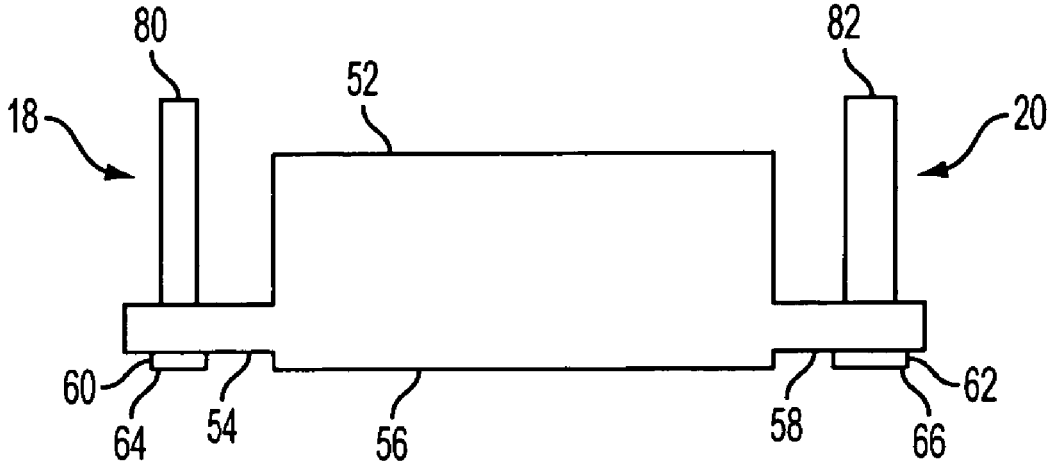
FIG. 3 is an elevational front view of the header shown in FIG. 2.
Figure 4:
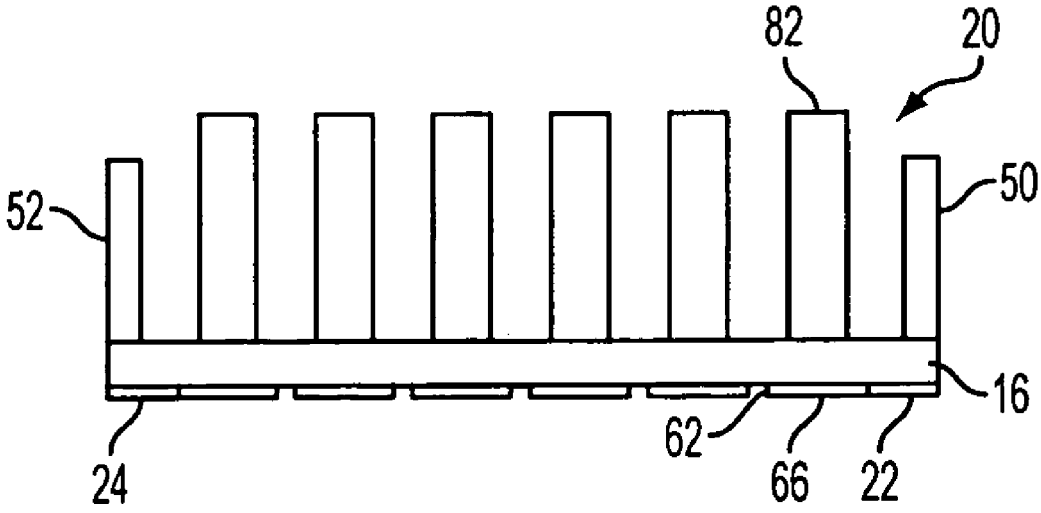
FIG. 4 is an elevational side view of the header shown in FIG. 2.
Figure 5:
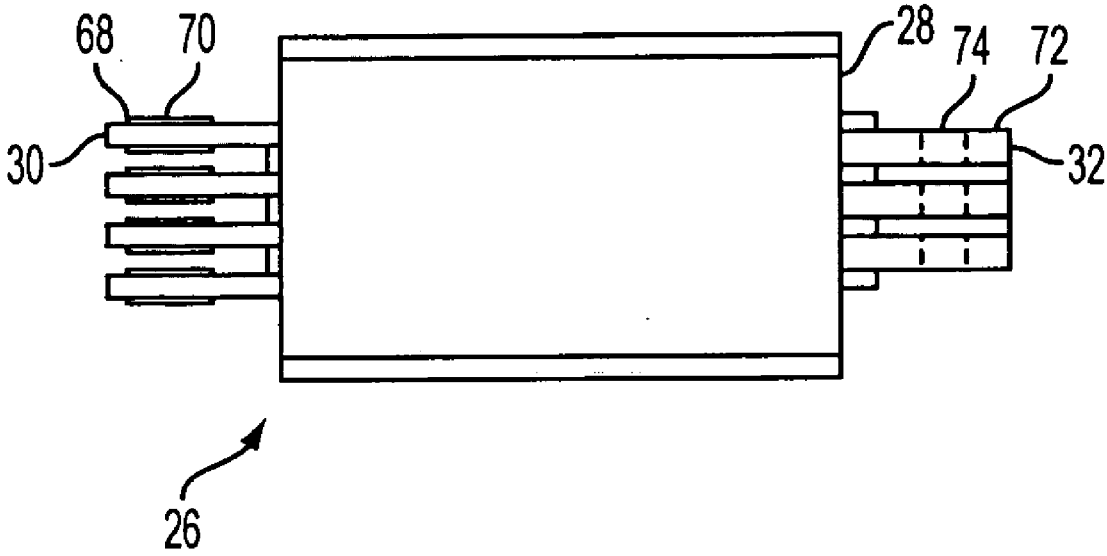
FIG. 5. is an elevational front view of the planar winding and core assembly of the planar transformer shown in FIG. 1.
Figure 6:
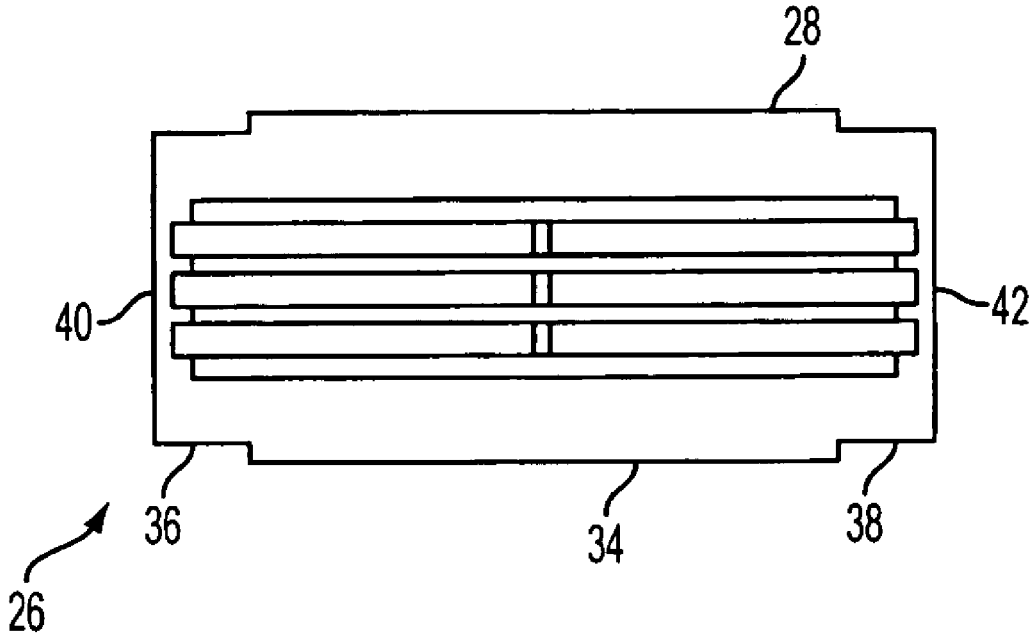
FIG. 6 is an elevational side view of the planar winding and core assembly shown in FIG. 5.
Figure 7:
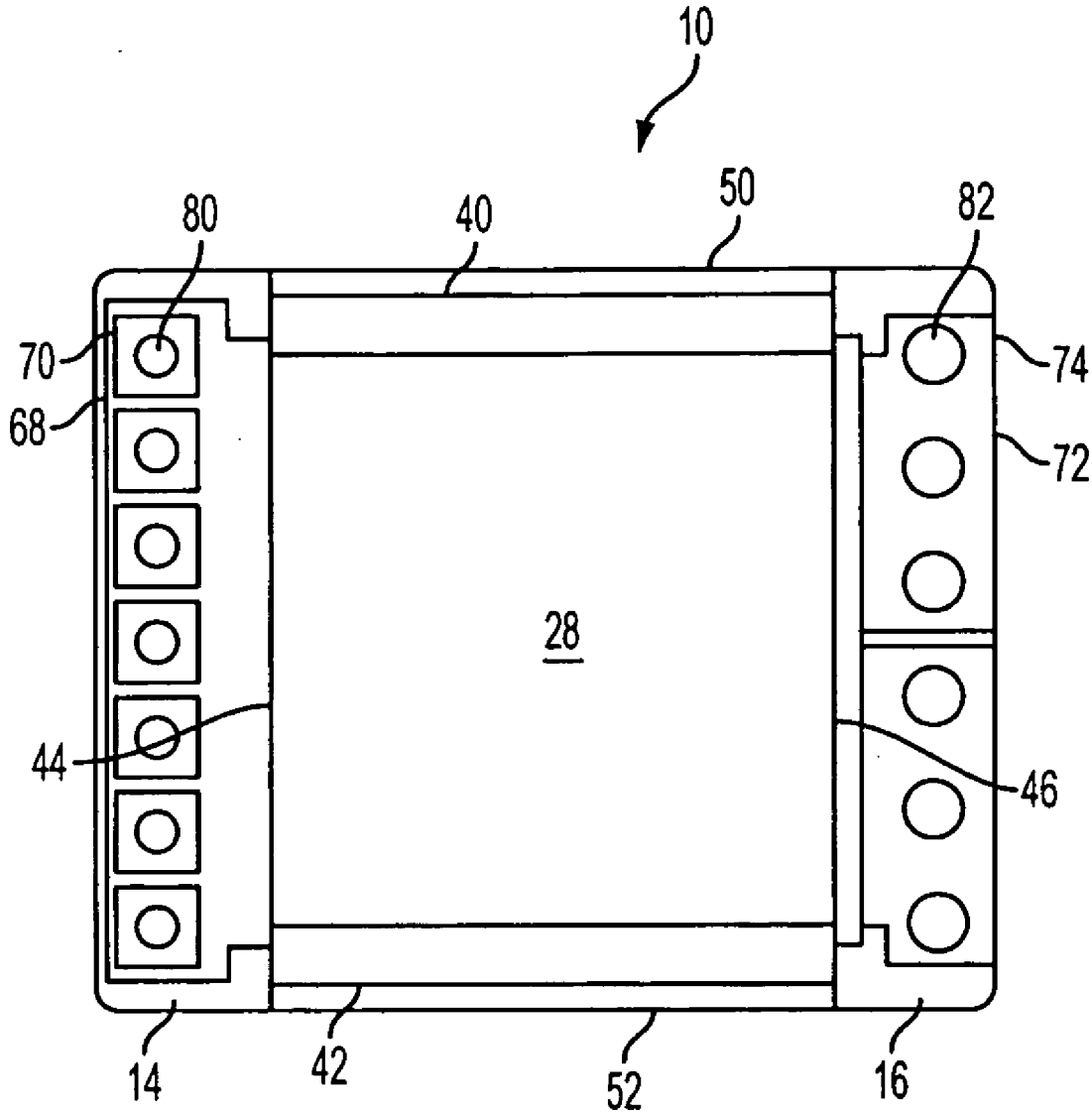
FIG. 7 is a top plan view of the planar transformer of the present invention.
Figure 8:
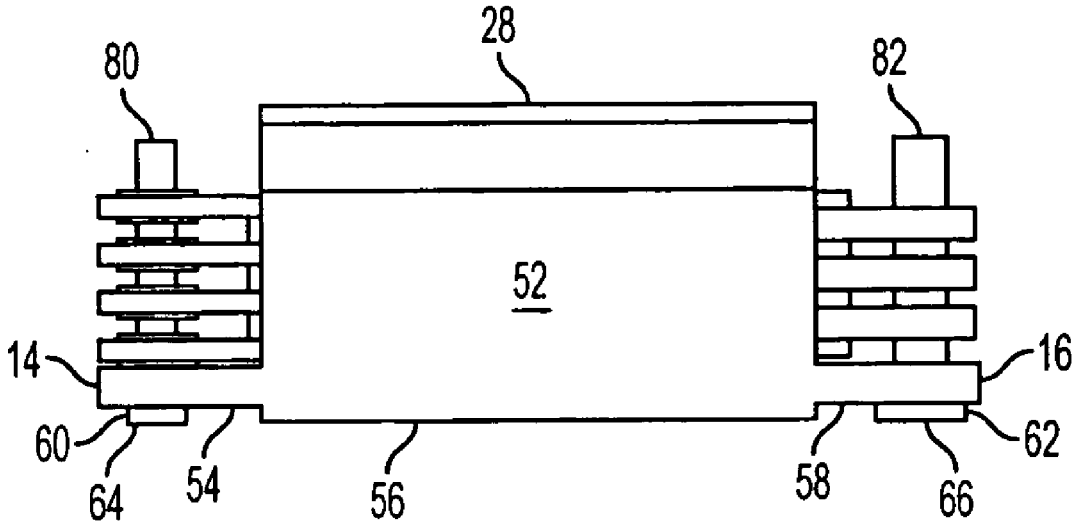
FIG. 8 is an elevational front view of the planar transformer shown in FIG. 1.
Figure 9:
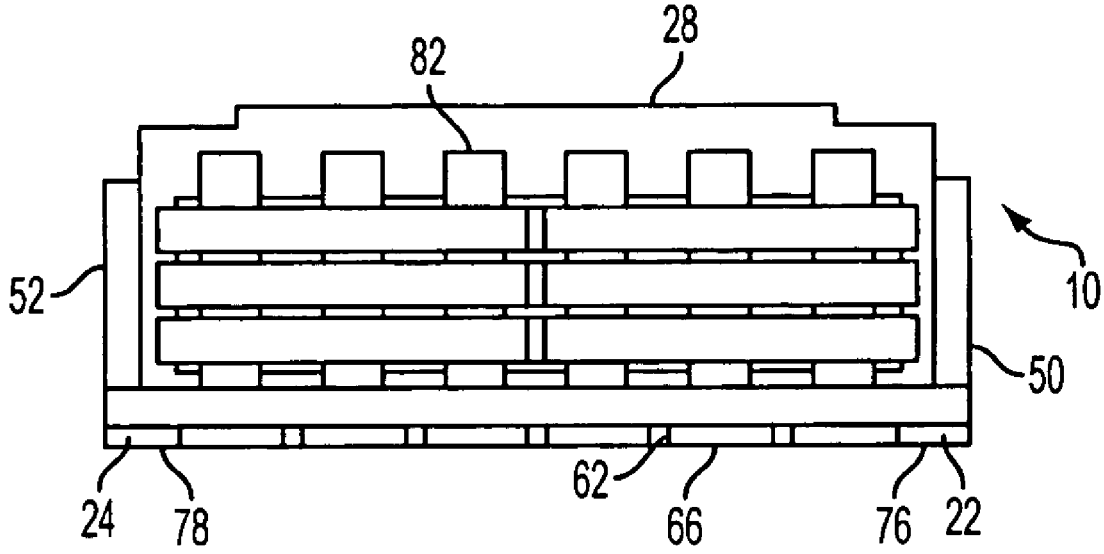
FIG. 9 is an elevational side view of the planar transformer shown in FIG. 1.

Referring to FIGS. 1–9, a planar transformer 10 has a header 12 which has a generally rectangular shape; however, other shapes, such as circular, can be used. Header 12 is made of plastic or other suitable material that is rigid and nonconductive, for example, ceramic. Header 12 has terminal sides 14 and 16 which are located on opposite sides of header 12. Terminal side 14 has a plurality of primary terminals 18 with heads 60 and pins 80, and terminal side 16 has a plurality of secondary terminals 20 with heads 62 and pins 82. Primary terminals 18 and secondary terminals 20 can be made of, for example brass or copper, or other suitable materials, as is known in the art. Primary terminals 18 and secondary terminals 20 are molded in place in terminal sides 14 and 16, respectively, during the manufacture of header 12 or rigidly attached to header 12 by other suitable means. Heads 60 of primary terminals 18 are adjacent bottom side 54 of terminal side 14, and pins 80 pass through terminal side 14. Heads 62 of secondary terminals 20 are adjacent bottom side 58 of terminal side 16, and pins 82 pass through terminal side 16. Pins 80 and 82 can be round, flat, or other shapes as is known in the art. Header 12 holds primary terminals 18 and secondary terminals 20 rigidly in position and maintains the coplanarity of primary terminals 18 and secondary terminals 20. Header 12 has side bars 22 and 24 which are located on opposite sides of header 12 and extend between the inside surfaces of terminal sides 14 and 16. The upper surfaces of side bars 22 and 24 are lower than the upper surfaces of terminal sides 14 and 16.

Core assembly 26 has a core 28 which contains a plurality of planar primary windings 30 and a plurality of planar secondary windings 32. Core 28 can be a two-piece molded ferrite core that consists of upper and lower sections. The bottom of core 28 has three sections, i.e., a center section 34 and end sections 36 and 38. End sections 36 and 38 are higher than center section 34 thereby creating indentations along the bottom of core 28 on sides 40 and 42 respectively that extend from side 44 to side 46. Core 28 is sized so that it fits in aperture 48 of header 12. End section 36 of the bottom of core 28 is positioned on side bar 22, and end section 38 of the bottom of core 28 is positioned on side bar 24. Center section 34 of the bottom of core 28 is positioned between the edges of side bars 22 and 24. Side 44 of core 28 is positioned adjacent to the inside edge of side 14 of header 12, and side 46 of core 28 is positioned adjacent to the inside edge of side 16 of header 12. Center section 34 of core 28 is sized so that when end section 36 is positioned on side bar 22 and end section 38 is positioned on side bar 24 center section 34 there is a slight gap between the bottom of center section 34 and the plane on which bottom surface 76 of side bar 22 and bottom surface 78 of side bar 24 rests. Side bars 22 and 24 allow core 28 to sit lower than prior art planar transformers. When planar transformer 10 is mounted on a mounting/cooling substrate, the slight air gap between the bottom of center section 34 and the surface of the mounting/cooling substrate can be filled with a soft bonding compound or insulating film with adhesive backing to allow heat transfer from core 28 to the surface of the mounting/cooling substrate. Soft bonding of core 28 to the mounting surface improves mechanical stability and resistance to shock and vibration. Insulating film under core 28 allows the traces on a printed circuit board to pass under core 28.

Header 12 has raised sidewalls 50 and 52, which are rectangularly shaped and extend perpendicularly from side bars 22 and 24, respectively. Sidewalls 50 and 52 are approximately as wide as sides 40 and 50 of core 28. Side 40 of core 28 is positioned adjacent sidewall 50 of header 12. Side 42 of core 28 is positioned adjacent sidewall 52 of header 12. Where sidewalls 50 and 52 meet side bars 22 and 24, respectively, the contact area may be an arc rather than a ninety degree angle to facilitate assembly and increase the strength of the intersection. Sidewalls 50 and 52 can have other shapes; however, the rectangular shape and maximum contact area with core 28 provides the advantages discussed below.

Terminal side 14 of header 12 has a bottom side 54 that is higher than bottom side 56 of sidewalls 50 and 52. Similarly, terminal side 16 of header 12 has a bottom side 58 that is higher than bottom side 56 of sidewalls 50 and 52. Bottom 64 of head 60 and bottom 66 of head 62 are coplanar with bottom side 56 of header 12.

Planar primary windings 30 have pads 68 with through-holes 70 that are sized so that pins 80 can be inserted and pass through. Similarly, planar secondary windings 32 have pads 72 with through-holes 74 that are sized so that pins 82 can be inserted and pass through. Pads 68 and 72 can be, for example, copper stampings. As core assembly 26 is positioned on header 12, pins 80 pass through through-holes 70, and pins 82 pass through through-holes 74. Sidewalls 50 and 52 assist in the alignment of core assembly 26 by guiding core assembly 26 into position on pins 80 and 82. Core 28 rests on and is supported by side bars 22 and 24. In addition to assisting in alignment during assembly, sidewalls 50 and 52 make the entire assembly stronger since they provide a large bonding surface. Core 28 is bonded or glued to side bars 22 and 24 and sidewalls 50 and 52 making an integrated package that holds together better than prior art planar transformers. Stampings 68 and 72 are electrically connected to pins 80 and 82, respectively, by soldering or other methods known in the art.

All of the terminals can have the same shape, such as round as illustrated above with the primary terminals all being of the same size and shape and the secondary terminals all being of the same size and shape. However, the terminals can be a combination of different sizes and types, such as round or flat. In addition, the core can have different shapes, such as square, rectangular, elliptical, or round, and the center aperture of the header will reflect the shape of the core. In addition to being molded in place, the terminals may be attached to the header by other suitable means. A planar transformer embodiment of the present invention has been described; however, the present invention also applies to other planar magnetic devices such as single or multi-coil inductors. The second set of pins in a planar transformer or multi-coil inductor can be located on the same side as the first set of pins, or the second set of pins can be located on an adjacent side or opposite side as described in the embodiment shown herein.

Figure 10:
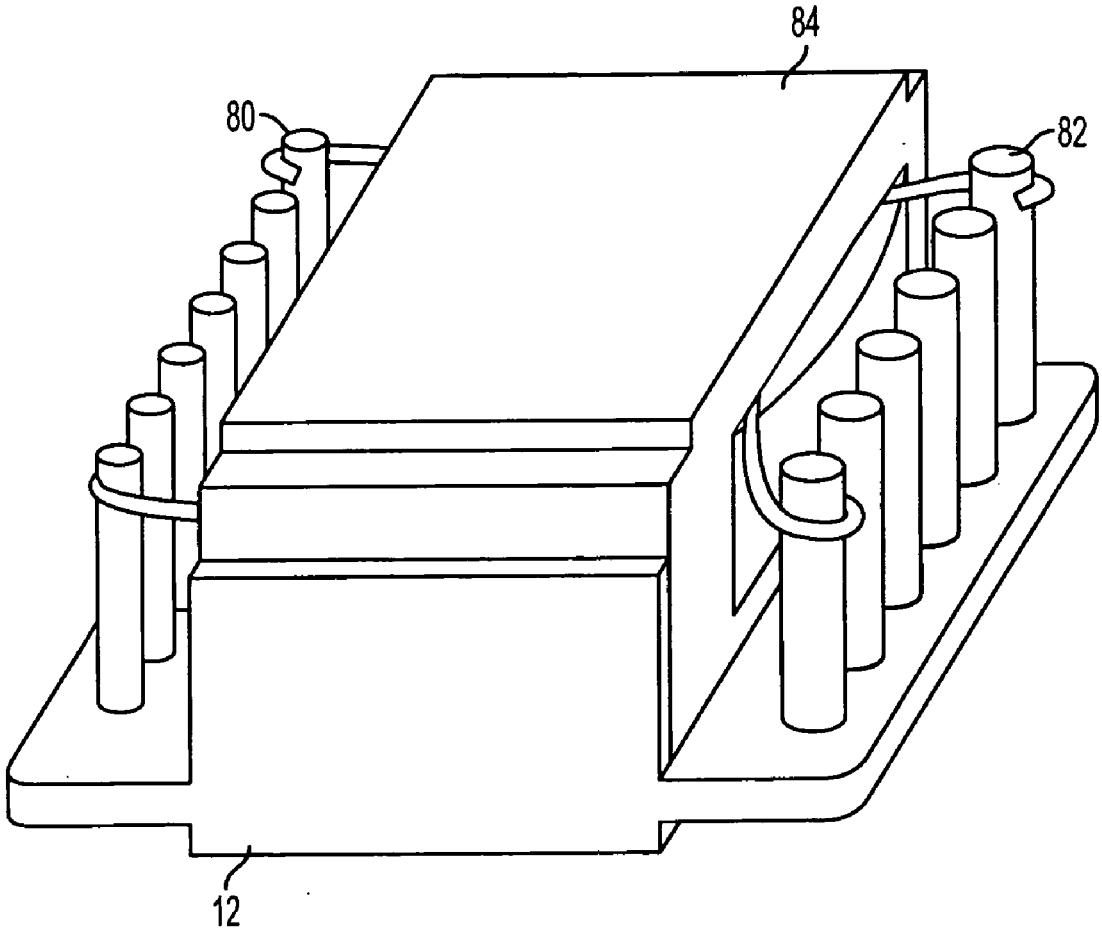
FIG. 10 is a perspective view of an alternative embodiment of the present invention.

FIG. 10 is a perspective view of an alternative embodiment of the present invention in which the planar core has been replaced by a wire wound core 84.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. A planar magnetic device comprising:

a molded header having first, second, third, and fourth sides and an aperture in the center, said first side having a plurality of first terminals positioned through said first side, and said third and fourth sides having upper surfaces that are lower than the upper surface of said first side; and a planar core assembly comprising a first planar winding having a plurality of first terminals on a side of said first planar winding, said first terminals having through-holes so that said first terminals of said header are positioned through said through-holes of said first terminals;

a core surrounding at least a portion of said first planar windings, said core being shaped so that a first portion of said core is positioned in said aperture below said upper surfaces of said third and fourth sides, a second portion of said core is positioned on the upper surface of said third side, and a third portion of said core is positioned on the upper surface of said fourth side.

2. A planar magnetic device as recited in claim 1, wherein said third and fourth sides of said header have respective raised portions and said core is positioned between said raised portions of said third and fourth sides of said header.

3. A planar magnetic device as recited in claim 2, wherein said raised portions of said third and fourth sides of said header are rectangularly shaped.

4. A planar magnetic device as recited in claim 3, wherein said raised portions of said third and fourth sides of said header are approximately as wide as said core.

5. A planar magnetic device as recited in claim 1, wherein said plurality of terminals of said header have a head and an elongated portion with said elongated portion being positioned through said header and said head located on the bottom of said header and wherein the bottom portion of said third and fourth sides is coplanar with the heads of said terminals.

6. A planar magnetic device as recited in claim 5, wherein the bottom portion of said core is higher than the bottom surface of the heads of said terminals.

7. A planar magnetic device as recited in claim 1, wherein said header is made of nonconductive material.

8. A planar magnetic device as recited in claim 7, wherein said header is made of plastic.

9. A planar magnetic device as recited in claim 1, wherein said core has a bottom, said first, second, and third portions are located on said bottom, and said bottom has an indentation in said second and third portions.

10. A planar transformer comprising:

a molded header having first, second, third, and fourth sides and an aperture in the center, said first side having a plurality of primary terminals positioned through said first side, said second side having a plurality of secondary terminals positioned through said second side, and said third and fourth sides having upper surfaces that are lower than the upper surfaces of said first and second sides; and a planar core assembly comprising a first planar winding having a plurality of first terminals on a side of said first planar winding, said first terminals having through-holes so that said primary terminals of said header are positioned through said through-holes of said first terminals;

a second planar winding having a plurality of second terminals on a side of said second planar winding, said second terminals having through-holes so that said secondary terminals of said header are positioned through said through-holes of said second terminals; and a core surrounding at least a portion of said first and second planar windings, said core being shaped so that a first portion of said core is positioned in said aperture below said upper surfaces of said third and fourth sides, a second portion of said core is positioned on the upper surface of said third side, and a third portion of said core is positioned on the upper surface of said fourth side.

11. A planar transformer as recited in claim 10, wherein said third and fourth sides of said header have respective raised portions and said core is positioned between said raised portions of said third and fourth sides of said header.

12. A planar transformer as recited in claim 11, wherein said raised portions of said third and fourth sides of said header are rectangularly shaped.

13. A planar transformer as recited in claim 12, wherein said raised portions of said third and fourth sides of said header are approximately as wide as said core.

14. A planar transformer as recited in claim 10, wherein said plurality of primary terminals and said plurality of secondary terminals of said header have a head and an elongated portion with said elongated portion being positioned through said header and said head located on the bottom of said header and wherein the bottom portion of said third and fourth sides is coplanar with the heads of said primary and secondary terminals.

15. A planar transformer as recited in claim 14, wherein the bottom portion of said core is higher than the bottom surface of the heads of said primary and secondary terminals.

16. A planar transformer as recited in claim 10, wherein said header is made of nonconductive material.

17. A planar transformer as recited in claim 16, wherein said header is made of plastic and said primary and secondary terminals are molded in place in said header.

18. A planar transformer as recited in claim 10, wherein said first side of said header is opposite said second side of said header and said third side of said header is opposite said fourth side of said header.

19. A planar transformer as recited in claim 10, wherein said core has a bottom, said first, second, and third portions are located on said bottom, and said bottom has an indentation in said second and third portions.

20. A magnetic device comprising:

a molded header having first, second, third, and fourth sides and an aperture in the center, said first side having a plurality of first terminals positioned through said first side, and said third and fourth sides having upper surfaces that are lower than the upper surface of said first side; and a wire wound core assembly comprising:

wire windings and a core surrounding at least a portion of said wire windings, said core being shaped so that a first portion of said core is positioned in said aperture below said upper surfaces of said third and fourth sides, a second portion of said core is positioned on the upper surface of said third side, and a third portion of said core is positioned on the upper surface of said fourth side.

21. A magnetic device as recited in claim 20, wherein said core has a bottom, said first, second, and third portions are located on said bottom, and said bottom has an indentation in said second and third portions.

22. A magnetic device as recited in claim 20, wherein said third and fourth sides of said header have respective raised portions and said core is positioned between said raised portions of said third and fourth sides of said header.

23. A magnetic device as recited in claim 22, wherein said raised portions of said third and fourth sides of said header are rectangularly shaped.

24. A magnetic device as recited in claim 23, wherein said raised portions of said third and fourth sides of said header are approximately as wide as said core.

25. A magnetic device as recited in claim 20, wherein said plurality of terminals of said header have a head and an elongated portion with said elongated portion being positioned through said header and said head located on the bottom of said header and wherein the bottom portion of said third and fourth sides is coplanar with the heads of said terminals.

26. A magnetic device as recited in claim 25, wherein the bottom portion of said core is higher than the bottom surface of the heads of said terminals.

27. A magnetic device as recited in claim 20, wherein said header is made of nonconductive material.

28. A magnetic device as recited in claim 27, wherein said header is made of plastic.

* * * * *